US006295660B1

(12) United States Patent
Schuster

(10) Patent No.: US 6,295,660 B1
(45) Date of Patent: Oct. 2, 2001

(54) TOILET TANK WITH SEDIMENT REMOVAL ASSEMBLY

(76) Inventor: Michael Schuster, 612 Nicholso St., Apt. 1, Joliet, IL (US) 60435

( * ) Notice: Subject to any disclaimer, the term of this patent is extended or adjusted under 35 U.S.C. 154(b) by 0 days.

(21) Appl. No.: 09/634,249

(22) Filed: Aug. 8, 2000

(51) Int. Cl.[7] ..... E03D 1/00
(52) U.S. Cl. ..... 4/353; 137/436
(58) Field of Search ..... 4/353, 490, 508; 137/432, 436, 437, 438, 441, 444; 134/104.1

(56) References Cited

U.S. PATENT DOCUMENTS

| | | | | |
|---|---|---|---|---|
| 136,128 | * | 2/1873 | Bralley | 4/490 X |
| 996,743 | * | 7/1911 | Yancey | 137/436 |
| 2,465,866 | * | 3/1949 | Gaines | 4/353 X |
| 3,321,972 | * | 5/1967 | Goldtrap | 4/353 X |
| 4,134,164 | * | 1/1979 | Sanmartin Rial | 4/353 |

FOREIGN PATENT DOCUMENTS

| | | | | |
|---|---|---|---|---|
| 1261922 | * | 1/1972 | (GB) | 4/353 |

* cited by examiner

*Primary Examiner*—Robert M. Fetsuga
(74) *Attorney, Agent, or Firm*—Ernest Kettelson

(57) ABSTRACT

A toilet tank with a sediment removal assembly comprises a flexible tube connected to the upper discharge spout of the intake standpipe in the toilet tank cavity, and a configured length of copper tubing connected to the flexible tube for water to flow therethrough when the float valve is open to flow water into the tank during a flushing operation. The copper tubing has a longitudinal section which extends downwardly and vertically from its connection to the flexible tube, an integrally joined first lateral or horizontal section curved or bent to lie on the bottom wall of the tank adjacent to the rear wall, and an integrally joined second lateral or horizontal section curved or bent to extend substantially normal to the first lateral section and lie on the bottom wall of the tank adjacent to the then facing end wall of the tank. The lateral sections of the copper tubing include small spaced apart apertures opening inwardly toward the center of the tank cavity, through which jets of water are emitted over the bottom wall of the tank as water flows through the flexible tube and copper tubing. The copper tubing terminates at an open free end adjacent the end wall of the tank along which it lies, such open free end facing the opposite side wall of the tank at its intersecting corner region where it meets the adjacent end wall. When water flows through the flexible tube and copper tubing it is spewed out in a stream directed toward the opposite side wall at the corner intersection. The impact of the water against the opposite side wall in that corner region forces the water to turn and begin to swirl in a circular whirlpool current or stream on the bottom wall of the tank. Such whirlpool current or stream, combined with the jets of water being emitted across the bottom wall of the tank from the small apertures of the lateral sections of the copper tubing, agitate the sediment accumulated at the bottom of the tank, raising the sediment into the whirling stream of water, and carrying the sediment with such whirling stream of water toward the centrally located drain in the bottom of the tank which is open during the flushing operation to carry water to the toilet bowl. Thus, during each flushing operation, sediment in the toilet tank is automatically flushed out of the tank into and through the toilet bowl, and on out the drain conduit leading ultimately to the sewer tile.

14 Claims, 4 Drawing Sheets

TOILET TANK WITH SEDIMENT REMOVAL ASSEMBLY

FIELD OF THE INVENTION

This invention relates to the field of toilet tanks and apparatus or methods to solve the problem of removing the sediment which accumulates therein. It relates particularly to a sediment removal assembly which cleans the tank out and removes the sediment during the operation of flushing the toilet.

BACKGROUND OF THE INVENTION

The only relevant prior art of which the inventor is aware consists of the following United States patents which were found in a search of the files in the United States Patent and Trademark Office, where complete details of each patent are readily available:

U.S. Pat. No. 5,862,537 for a Flush Lever Operated Reservoir Toilet Tank Control.

U.S. Pat. No. 5,794,279 for a Water Saver Attachment for Toilets.

U.S. Pat. No. 4,898,124 for a Scale Agitator.

U.S. Pat. No. 4,505,231 for a Water Heater Construction With Sediment Removal Means.

U.S. Pat. No. 3,762,395 for a Device For Preventing Sediment Build-Up In Gas Water Heaters.

U.S. Pat. No. 2,736,037 for an Automatic Valve Apparatus.

U.S. Pat. No. 1,113,057 for a Cuspidor

SUMMARY OF THE INVENTION

The toilet tank with sediment removal assembly in accordance with this invention comprises a configured tubular assembly connected at its upper end to an additional outlet water spout provided at the upper end of the intake standpipe, adjacent the conventional outlet spout which flows water through a tube to the toilet bowl. This additional spout with the tubular assembly connected thereto, Flows water into and through the tubular assembly during the flushing operation of the toilet. At such time, water in the tank is also being ejected through the outlet ports provided around the periphery of an annular discharge member at the bottom of the tank into the toilet bowl in accordance with this invention, to create a current flow across the surface of the bottom wall of the tank that begins to lift and carry any sediment on the bottom of the tank. Thus, while water is beginning to flow upward through the standpipe into the tank to refill the tank to its proper level, water is also being emitted through the discharge ports around the lower portion of the standpipe. A float valve assembly opens to admit water into the standpipe and tank when the float drops with the water level as water drains out from the tank during the toilet flushing operation.

The configured tubular assembly has a vertically extending section which reaches down to lie on the bottom of the tank where it curves or bends into an elongated horizontal section that lies adjacent to the inside lower edge of the rear side wall of the tank. That elongated section then bends or curves as it approaches the facing end wall of the tank into a shorter horizontal section that lies adjacent to the inside lower edge of that end wall, and that extends in a direction toward the opposite side wall of the tank where the tubular assembly terminates in an open free end.

During the flushing operation when water flows into and through the configured tubular assembly, water is flowed in a rapid stream out from the open free end in the direction toward the opposite side wall of the tank at its intersecting corner with the end wall. This rapid flow of water along a portion of the end wall and impact of such stream with the opposite side wall starts to direct the stream in a swirling circular manner. This agitates the water at the bottom of the tank, and in conjunction with the jets of water being emitted from the discharge ports around the annular member at the lower end of the standpipe, raises the sediment from the bottom whereby it begins to be carried by the swirling stream of water as it rotates and swirls toward the drain in the bottom of the tank through which the water is being flowed from the tank to the toilet bowl during the flushing operation.

To add to the swirling circular motion, one or both of the horizontal sections of the tubular assembly are provided with a plurality of small spaced apart ports or apertures opening in the direction away from the tank walls each lies adjacent to and toward the respective opposite side and end walls. Thus, as water flows through the tubular assembly, a portion of the water is forced out through the plurality of small ports and directed across the bottom wall of the tank to further agitate and dislodge sediment on the bottom. The combined operation of the jet of water emitted from the open free end of the tubular assembly hitting the opposite side wall at the corner of the adjacent end wall to begin the swirling circular motion of the water, plus the jets of water being emitted through the small ports of the tubular sections lying along the bottom edge of one side wall and one end wall, plus the jets of water being forced through the discharge ports of the annular member at the lower end of the standpipe, create a turbulent, swirling and circular current or stream of water sufficient to dislodge sediment from the bottom of the tank and carry it to the drain outlet where it is sucked out along with the larger stream of water which is being flowed from the tank into the toilet bowl during the flushing operation.

DESCRIPTION OF THE PREFERRED EMBODIMENT

Figure 1:
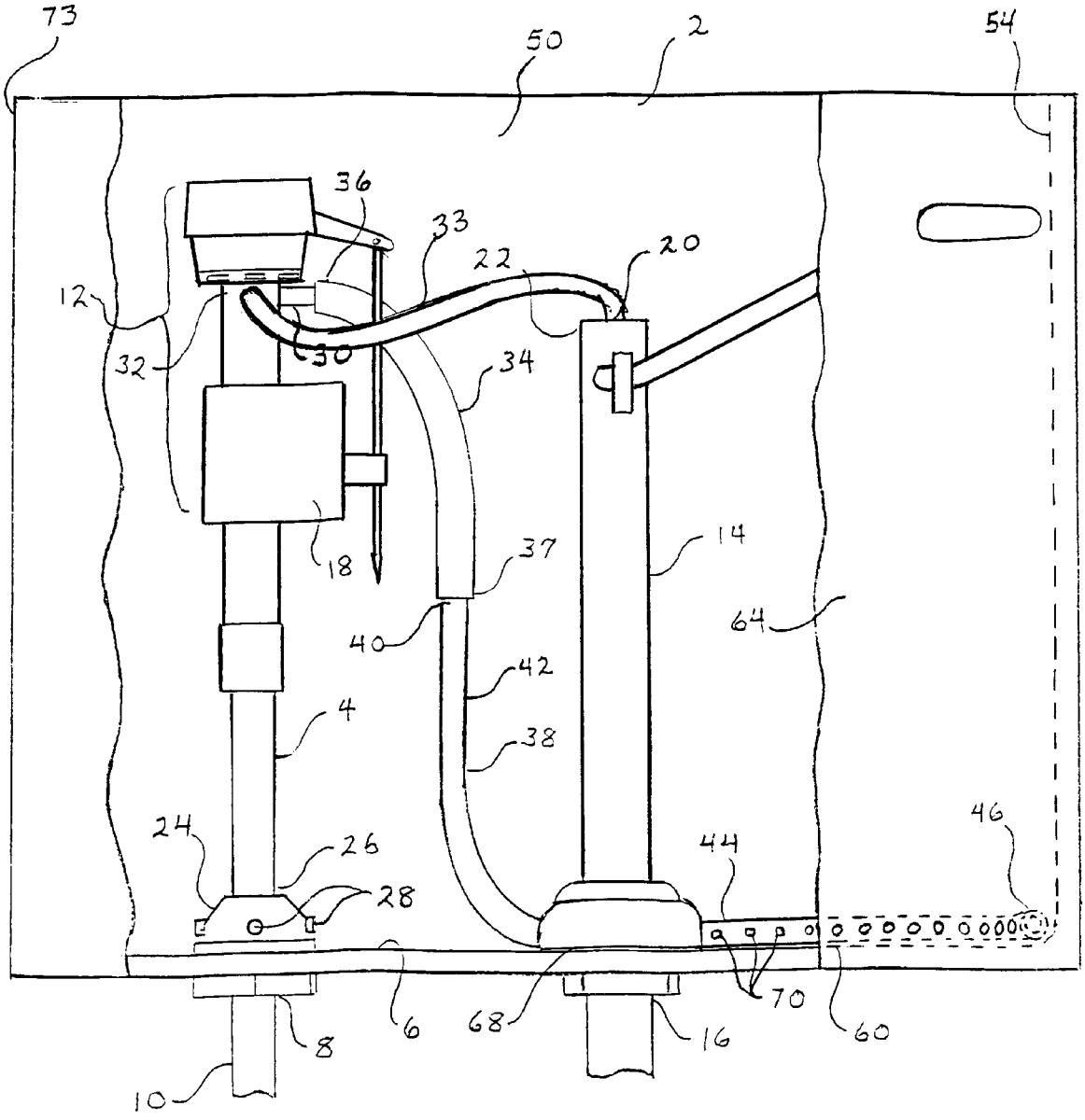
FIG. 1 is an elevation view of a toilet tank with the front wall partially broken away to show the sediment removal assembly in accordance with this invention.
Figure 2:
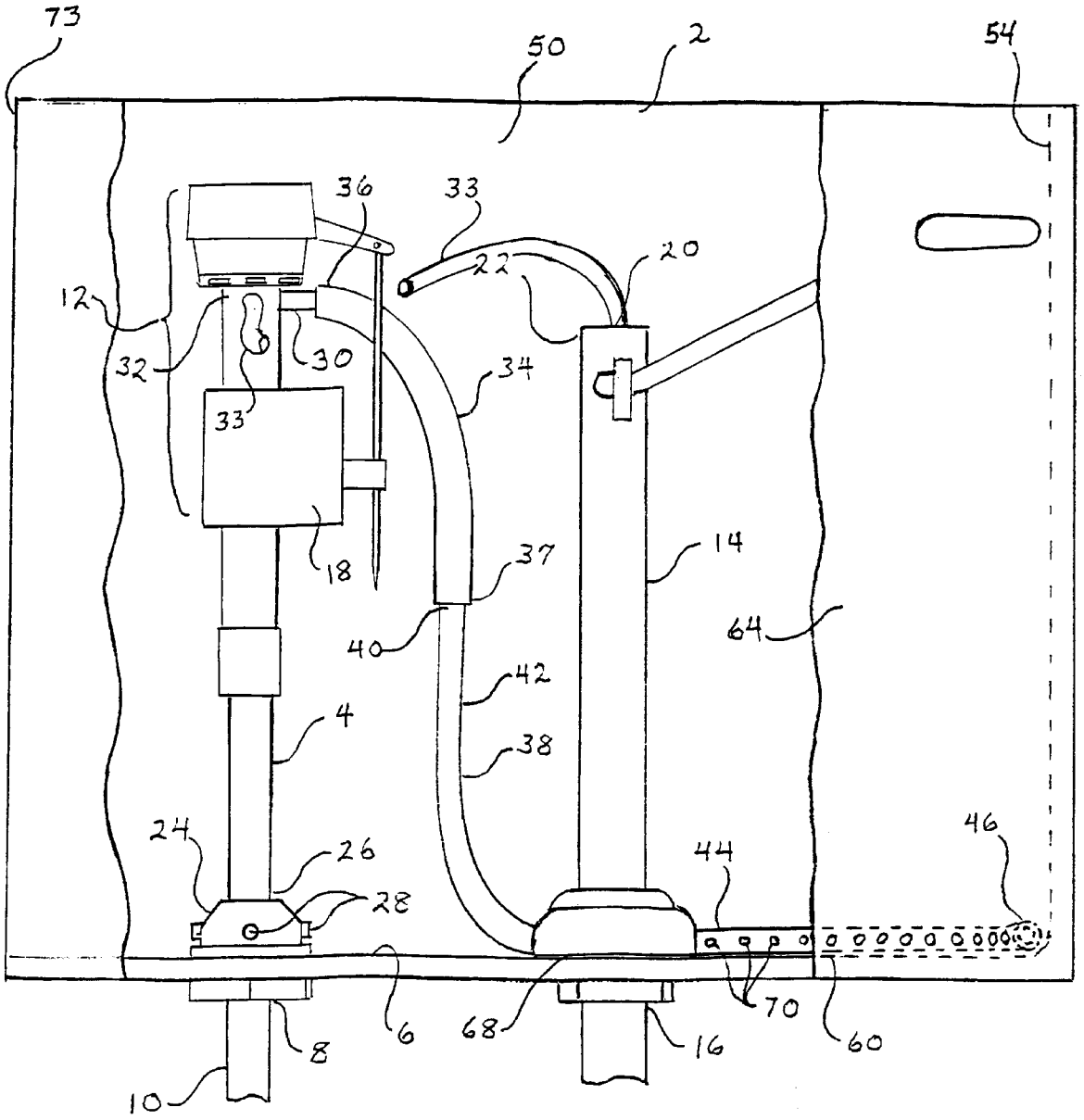
FIG. 2 is an elevation view of the toilet tank as seen in FIG. 1 with the discharge tube connected to the conventional water spout at the upper end of the standpipe partially broken away to more clearly show the tubular assembly connected to the additional discharge spout of this invention at the upper end of the standpipe adjacent to and radially spaced apart from the conventional water spout.
Figure 3:
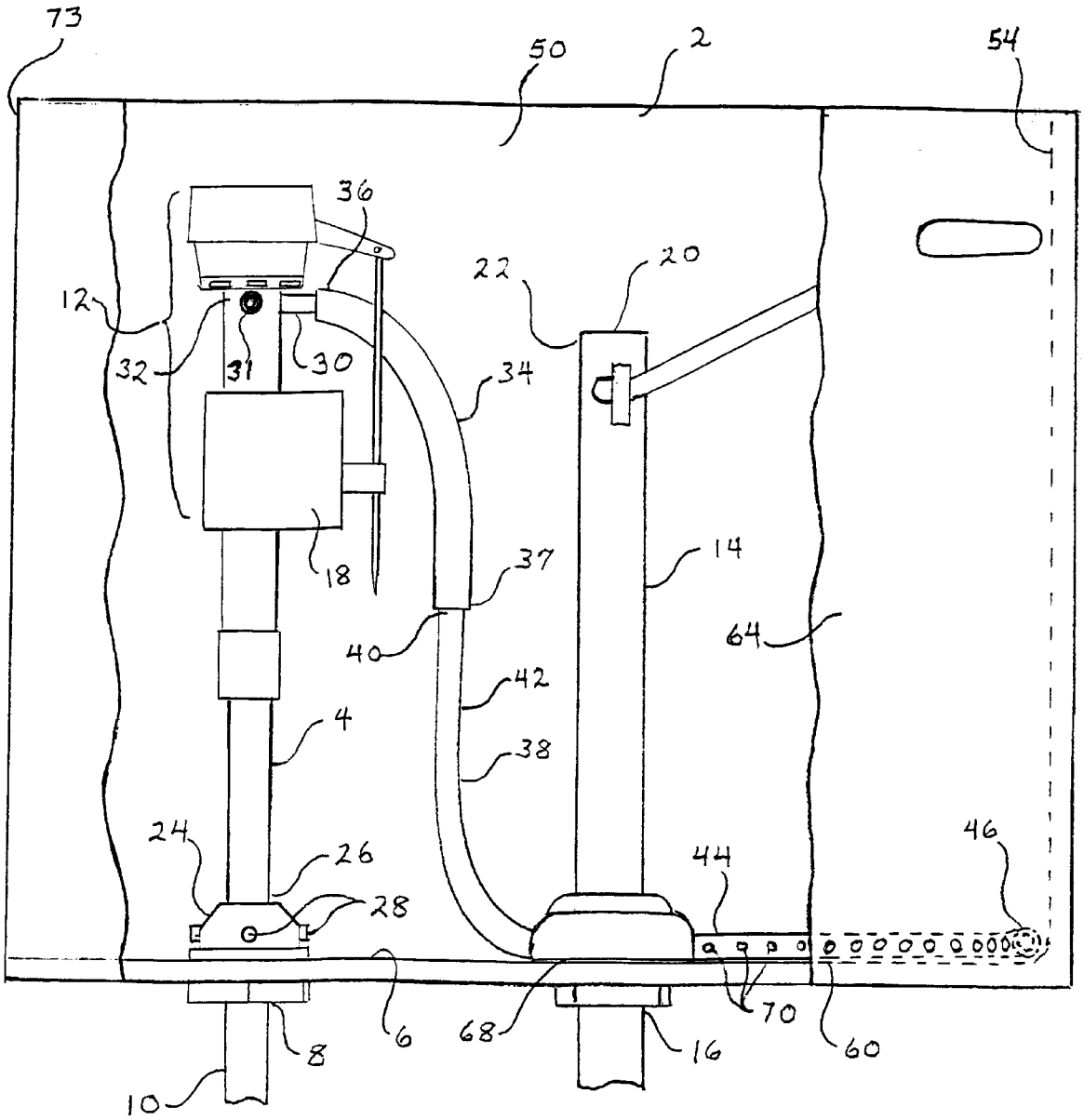
FIG. 3 is an elevation view of the toilet tank as seen in FIGS. 1 and 2, with the discharge tube normally connected to the conventional discharge spout removed to show the conventional discharge spout itself.
Figure 4:
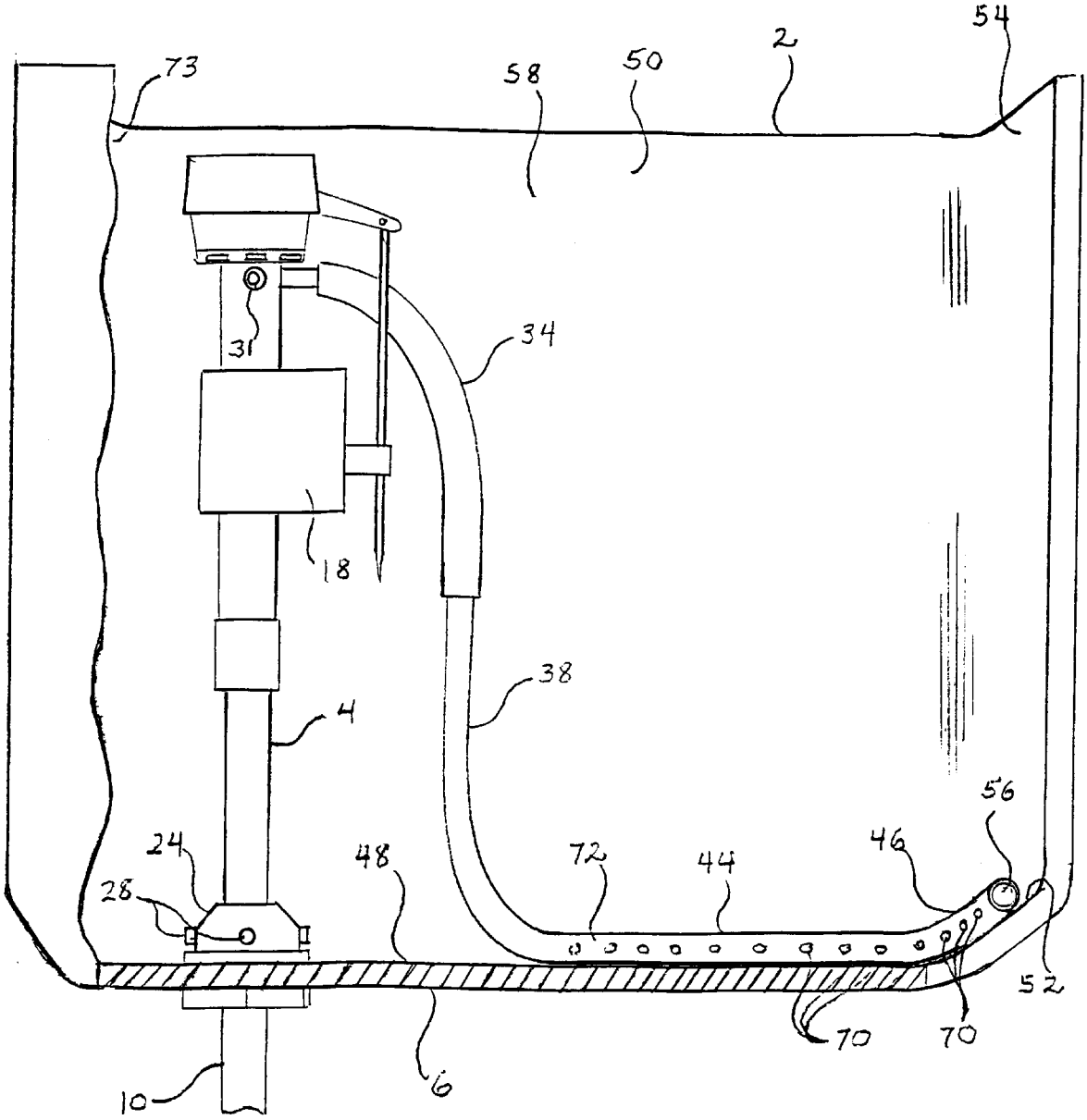
FIG. 4 is a perspective view taken from the interior of the toilet tank shown in FIG. 1 with a center portion of the bottom wall shown in section taken on a line behind the overflow pipe seen in FIG. 1, to more clearly show the entire flexible tubing and the integrally formed copper tubing sections that would otherwise be partially concealed; a portion of the front wall of the tank is shown broken away toward the left.

A toilet tank assembly with sediment removal assembly in accordance with this invention comprises a storage tank 2 having a standpipe 4 extending upright from the bottom wall 6 of the tank 2, with a connecting portion 8 extending through the bottom wall 6. A water inlet assembly comprising a supply conduit 10 is connected to the connecting portion 8 of the standpipe below the bottom wall 6 of the tank. The supply conduit 10 leads to a pressurized water supply. A float valve assembly 12 is connected to the standpipe 4 to admit water into the storage tank 2 when in the valve open position and to prevent flow of water through the standpipe and into the tank 2 when in the valve closed position.

An overflow pipe 14 also extends upwardly from the bottom wall 6 of the storage tank, having a portion 16 which extends through the bottom wall for connection to a drain outlet. The float 18 of the float valve assembly rises with the water level as water is flowing through the standpipe 4 into the tank 2 until the tank is filled to the selected level, shortly below the level of the inlet port 20 opening to the upper end 22 of the overflow pipe 14. When that water level is reached, the float 18 has risen to the level at which it moves the valve stem and closure member of the valve assembly 12 to the valve closed position, whereupon flow of water into the storage tank is discontinued.

The sediment removal assembly in accordance with this invention includes the following components. An annular member 24 in accordance with this invention is provided around the lower end 26 of the standpipe 4, having four radially spaced apart outlet ports 28 to discharge water in laterally directed streams or jets from the interior passageway of the standpipe as water is flowed therethrough when the storage tank 2 is being filled. A laterally extending discharge spout 30 in accordance with this invention is provided at the upper end region 32 of the standpipe 4 through which water is also discharged in a lateral stream when water is flowing into and through the standpipe 4. The discharge spout 30 is adjacent to and radially spaced apart from the conventional discharge spout 31 to which one end of the tube 33 is connected, the other end positioned to discharge water into the pipe 14 from which the water flows into the toilet bowl during the flushing operation to refill the bowl after the flushed water has been drained out.

In addition to the annular member 24 and the outlet jets or ports 28, the sediment removal assembly in accordance with this invention also includes a circulating flow assembly comprising a flexible tube 34 or flexible conduit connected at one end 36 to the discharge spout 30. The flexible tube 34 hangs downward from the spout 30 and is connected at its lower end 37 to a copper tube 38. The flexible tube 34 in accordance with a preferred embodiment of the invention is about eight inches long. The copper tube 38 has an upper end 40 which is connected to the lower end 37 of the flexible tube 34. The copper tube 38 has a longitudinal section 42 which hangs downwardly from the flexible tube 34 about five to six inches, whereupon it curves or bends to extend laterally about nine inches in a first laterally extending section 44. The copper tube 38 then curves or bends to extend laterally in a second laterally extending section 46 which extends in a direction substantially normal to the first laterally extending section 44. The first laterally extending section 44 is about nine to ten inches in length. The second laterally extending section 46 is about three to four inches in length.

All sections of the copper tube 38 are continuously integrally joined as a single unitary tube. The dimensions of each section, and the dimension of the flexible tube 34 may vary depending on the size of the storage tank in which the tube is to be used.

The combined length of the flexible tube 34 and the longitudinal section 42 of the copper tube 38 is sufficient to reach from the discharge spout 30 at the upper end of the standpipe 4 to the bottom wall 6 of the storage tank 2. The first laterally extending section 44 of the copper tube 38 lies on the inner surface of the bottom wall 6, along its side edge 48 and adjacent the lower edge of side wall 50 of the storage tank 2 until it approaches the end edge 52 of the bottom wall 6 and the lower edge of end wall 54 of the storage tank 2. At this point the integrally formed second laterally extending section 46 extends in a direction substantially normal to the first laterally extending section 44, and lies on the inner surface of the bottom wall 6 along the end edge 52 thereof and adjacent the lower edge of the end wall 54 of the storage tank 2.

The free end 56 of the copper tube 38 is open for discharge of water flowing from the discharge spout 30 of standpipe 4 through the flexible tube 34 and copper tube 38 into the cavity 58 of the tank 2. The free end 56 of the copper tube 38 lies along the end edge 52 of the bottom wall 6 near and facing the opposite side edge 60 of the bottom wall and the lower edge of the opposite side wall 64 of the storage tank 2. Thus, water being discharged from the open free end 56 of the copper tube at such location will spew against the lower edge region of the side wall 64 of the storage tank and begin to flow from the corner region of the end wall 54 and the intersecting opposite side wall 64 in a swirling manner along the lower edge of side wall 64 and the opposite side edge 60 of the bottom wall 6 of the storage tank 2. This discharge and swirling flow of water on the inner surface of the bottom wall 6 of the storage tank 2 creates a swirling or circular stream of water that lifts sediment from the bottom wall of the tank and carries the sediment in such circular stream toward the drain outlet 68 in the central portion of the bottom wall 6.

The laterally extending sections 44 and 46 of the copper tube 38 include a plurality of spaced apart small apertures 70 through the tubular wall 72 thereof. The apertures 70 of the first laterally extending section 44 open in the direction away from the first storage tank side wall 50 which the first laterally extending section 44 lies adjacent to, and toward the opposite side wall 64 of the tank 2. The apertures 70 of the second laterally extending section 46 open in the direction away from the end wall 54 which that section of the copper tube 38 lies adjacent to, and toward the opposite end wall 73 of the storage tank 2.

Thus, as water is discharged from the discharge spout 30 into and through the flexible tube 34 and copper tube 38, a portion of such water is emitted in small jet like streams out through such small apertures 70 at the level of the bottom wall 6 of the tank 2, from side wall 50 toward opposite side wall 64, and from end wall 54 toward opposite end wall 73 of the tank 2. This supplements and reinforces the swirling circular stream of water resulting from the water being spewed from the free end 56 of the copper tube 38 as described above, and the jets of water being ejected through the ports 28 of the annular member 24 at the lower end of the standpipe 4.

Water is discharged from the spout 30 when the toilet is flushed which empties the water in the tank 2 into the toilet bowl, whereupon the float 18 of the float valve assembly drops moving the valve closure member in the standpipe 4 to the valve open position thus admitting water into and through the standpipe into the cavity 58 of the tank 2 to refill. It is during this refill operation that water is discharged through the jets or ports 28 of the annular member 24 across the surface of the bottom wall 6 of the tank 2, through the spout 30, through the flexible tube 34 and the sections of the copper tube 38 to create the swirling circular stream of water around the bottom of the tank 2. Such discharge of water to create such swirling circular stream of water around the bottom of the tank begins while water is still being drained from the tank to complete the flush operation, so that water and the sediment being carried thereby drains out through the drain outlet 68 into the toilet bowl and from there to the conduit leading to the sewer tile.

In accordance with the present invention, each time the toilet is flushed, the sediment removal assembly as shown and described herein provides a swirling circular current or stream of water in the manner of a whirlpool at the bottom of the tank sufficient to lift and carry any sediment from the bottom region of the tank out thereof as part and parcel of the flushing operation.

I claim:

1. A toilet tank with sediment removal assembly comprising a water storage tank, water inlet means to flow water into said tank, water outlet means to flow water out of said tank, and sediment removal means for removal of sediment from said tank operatively associated with said water inlet means, said water storage tank having a bottom wall, said water outlet means comprising a drain outlet opening to said bottom wall, said sediment removal means including an elongated portion, said elongated portion thereof being on said bottom wall, said elongated portion having discharge means, said discharge means comprising openings aimed to contact sediment on said bottom wall and move said sediment up from as well as along said bottom wall toward and out through said drain outlet in said bottom wall.

2. A toilet tank with sediment removal assembly as set forth in claim 1, wherein said sediment removal means includes circulating flow means to provide a circulating flow of water in said tank to draw particles of sediment into said circulating flow and carry them out of said tank through said water outlet means, said circulating flow means including said elongated portion on said bottom wall of said water storage tank.

3. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means is located along said lower edge of said first side wall to direct a flow of water in the direction from said first side wall toward said second side wall, at the level of said bottom wall of said water storage tank and in a direction substantially parallel thereto.

4. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means is located along said lower edge of said first end wall to direct a flow of water in the direction from said first end wall toward said second end wall, at the level of said bottom wall of said water storage tank and in a direction substantially parallel thereto.

5. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means is located along said lower edge of said first side wall to direct a flow of water along said lower edge of said first end wall in the direction toward said second side wall, at the level of said bottom wall of said water storage tank and in a direction substantially parallel thereto.

6. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means includes a longitudinal tubular section, said longitudinal tubular section being located along said lower edge of said first side wall, said longitudinal tubular section having a plurality of small apertures opening in the direction from said first side wall toward said second side wall to flow water in said direction, at the level of said bottom wall of said water storage tank and in a direction substantially parallel thereto.

7. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means includes a lateral tubular section, said lateral tubular section being located along said lower edge of said first end wall, said lateral tubular section having a plurality of small apertures opening in the direction from said first end wall toward said second end wall to flow water in said direction, at the level of said bottom wall of said water storage tank and in a direction substantially parallel thereto.

8. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means includes a first tubular section, said first tubular section being located along said lower edge of said first side wall, said first tubular section having a plurality of small spaced apart apertures opening in the direction from said first side wall toward said second side wall, said circulating flow means includes a second tubular section, said second tubular section being located along said lower edge of said first end wall, said second tubular section terminating in an open free end to direct water along a portion of said lower edge of said first end wall in the direction toward said second side wall, at the level of said bottom wall of said water storage tank and in a direction substantially parallel thereto.

9. A toilet tank with sediment removal assembly as set forth in claim 8, wherein said first and second tubular sections of said circulating flow means are integrally joined.

10. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means includes a first tubular section, said first tubular section being located along said lower edge of said first side wall, said first tubular section having a plurality of small spaced apart apertures opening in the direction from said first side wall toward said second side wall, said circulating flow means includes a second tubular section, said second tubular section being located along said lower edge of said first end wall, said second tubular section terminating in an open free end to direct water along a portion of said lower edge of said first end wall in the direction toward said second side wall, said second tubular section having a plurality of small spaced apart apertures opening in the direction from said first end wall toward said second end wall, at the level of said bottom wall of said water storage tank and in a direction substantially parallel thereto.

11. A toilet tank with sediment removal assembly as set forth in claim 10, wherein said water inlet means includes an inlet pipe extending upwardly in said tank, said inlet pipe being connected to a pressurized water supply, valve means operable between a valve open and valve closed position, wherein said water outlet means includes said drain outlet to flow water out of said tank, said sediment removal means includes a tubular member in water flowing communication with said inlet pipe to receive a flow of water therein and therethrough while said valve means is still in a said valve open position, said tubular member of said sediment removal means being connected to said elongated portion of said circulating flow means to direct a flow of water to and through said circulating flow means, at the level of said bottom wall of said water storage tank and in a direction substantially parallel thereto.

12. A toilet tank with sediment removal assembly as set forth in claim 2, wherein said water storage tank includes a first side wall, a lower edge of said first side wall, an opposite second side wall, a lower edge of said second side wall, a first end wall between said first and second side walls at one of the ends thereof, a lower edge of said first end wall, a second end wall between said first and second side walls at the opposite ends thereof, a lower edge of said second end wall, said elongated portion of said circulating flow means includes a first tubular section, said first tubular section being located along said lower edge of said first side wall, said first tubular section having a plurality of small spaced apart apertures opening in the direction from said first side wall toward said second side wall, said small spaced apart apertures being comprised in said openings aimed to contact sediment on said bottom wall, said elongated portion of said circulating flow means includes a second tubular section, said second tubular section being located along said lower edge of said first end wall, said second tubular section terminating in an open free end to direct water along a portion of said lower edge of said first end wall in the direction toward said second side wall, said second tubular section having a plurality of small spaced apart apertures opening in the direction from said first end wall toward said second end wall, said small spaced apart apertures being comprised in said openings aimed to contact sediment on said bottom wall, said circular flow means including an additional water discharge means spaced apart from said second tubular section in the direction toward said second end wall, at the level of said bottom wall of said water storage tank and in a direction substantially parallel thereto.

13. A toilet tank with sediment removal assembly as set forth in claim 12, wherein said additional water discharge means includes an annular member, said annular member being in communication with a source of pressurized water, said annular member including a laterally extending port opening in the direction toward said first end wall, at the level of said bottom wall of said water storage tank and in a direction substantially parallel thereto to flow water and sediment out through said drain outlet in said bottom wall.

14. A toilet tank with sediment removal assembly as set forth in claim 12, wherein said additional water discharge means includes an annular member adjacent to said bottom wall of said tank, said annular member being in communication with a source of pressurized water, said annular member including a plurality of radially spaced apart ports to emit pressurized water therefrom along and across said bottom wall of said tank, at the level of said bottom wall of said water storage tank and in a direction substantially parallel thereto to flow water and sediment out through said drain outlet in said bottom wall.

* * * * *